United States Patent [19]

Sheeran

[11] Patent Number: 4,832,678

[45] Date of Patent: May 23, 1989

[54] ADAPTER FOR A CENTRIFUGE TUBE AND A REMOVAL TOOL THEREFOR

[75] Inventor: Edward T. Sheeran, Southbury, Conn.

[73] Assignee: E. I. Du Pont de Nemours and Company, Wilmington, Del.

[21] Appl. No.: 128,410

[22] Filed: Dec. 3, 1987

[51] Int. Cl.[4] ..... B04B 5/02

[52] U.S. Cl. ..... 494/16; 422/104; 494/20; 494/85

[58] Field of Search ..... 494/20, 16, 81, 85, 494/45, 17, 21, 29, 38; 206/499, 306; 211/74; 220/409, 408, 903; 422/104; 248/311.2, 314; 210/360.1, 781, 782

[56] References Cited

U.S. PATENT DOCUMENTS

| | | | |
|---|---|---|---|
| Re. 30,276 | 5/1980 | Rohde . | |
| 3,266,718 | 4/1964 | Stahl et al. . | |
| 3,393,864 | 7/1968 | Galasso et al. . | |
| 3,456,876 | 7/1969 | McEwen . | |
| 3,674,197 | 7/1972 | Mitchell et al. . | |
| 3,752,390 | 8/1973 | Chulay . | |
| 3,918,920 | 11/1975 | Barber . | |
| 4,030,663 | 6/1977 | Conn et al. . | |
| 4,032,066 | 6/1977 | Wright . | |
| 4,135,660 | 1/1979 | Conn et al. . | |
| 4,141,489 | 2/1979 | Wright . | |
| 4,147,294 | 4/1979 | Davidson et al. . | |
| 4,148,433 | 4/1979 | Bayley . | |
| 4,290,550 | 9/1981 | Chulay et al. . | |
| 4,295,601 | 10/1981 | Cowell . | |
| 4,301,964 | 11/1981 | Cowell . | |
| 4,306,676 | 12/1981 | Edwards et al. . | |
| 4,360,150 | 11/1982 | Ishimaru et al. . | |
| 4,375,272 | 3/1983 | Sutton | 494/16 |
| 4,389,374 | 6/1983 | Sutton et al. | 422/104 |
| 4,427,406 | 1/1984 | Nielsen | 494/16 |
| 4,439,177 | 3/1984 | Conway | 494/20 |
| 4,451,250 | 5/1984 | Romanauskas | 494/85 |
| 4,484,907 | 11/1984 | Sheeran, Jr. | 494/85 |
| 4,511,349 | 4/1985 | Nielsen et al. | 494/16 |
| 4,512,202 | 4/1985 | Wright et al. | 73/863 |
| 4,659,324 | 4/1987 | Sutton | 494/20 |
| 4,692,137 | 9/1987 | Anthony | 494/85 |

OTHER PUBLICATIONS

DuPont catalog, Aug. 1985, pp. 81–86, 87, 88.
Beckman catalog, Jan. 1985, p. 30.

*Primary Examiner*—Timothy F. Simone

[57] ABSTRACT

A tube adapter for a centrifuge rotor is characterized by generally circumferentially extending latching surfaces which are engageable by the claws of a removal tool to extract the adapter from the recess of a rotor. The latching surfaces may be defined by a continuous groove or by a pair of groove segments formed on the body of the adapter.

18 Claims, 2 Drawing Sheets

ADAPTER FOR A CENTRIFUGE TUBE AND A REMOVAL TOOL THEREFOR

BACKGROUND OF THE INVENTION

Field of the Invention

The present invention relates to an adapter for a centrifuge tube and to a removal tool for removing the adapter from the centrifuge tube.

Description of the Prior Art

A centrifuge rotor is a device used with a centrifuge instrument in order to subject a sample of a liquid to a centrifugal force field. The sample is carried in a suitable container, such as a test tube. The sample container is itself received within a recess provided in the body of the centrifuge rotor. The axis of the recess may be parallel to or inclined with respect to the axis of rotation of the rotor. The rotor in the latter case is known as a fixed angle rotor.

The sample container may, in some cases, exhibit a physical size that differs from the physical dimension of the recess in the centrifuge rotor in which it is received. In these instances the sample container is introduced into the recess using an intermediate device called an adapter. The adapter is externally dimensioned and configured in a manner that makes it compatible for receipt within the recess in the centrifuge rotor and is internally dimensioned and configured to accept the sample container. The adapter with the sample container received therein are thus receivable as a unit within the recess of the rotor and the sample may be thus exposed to the centrifugal force field upon rotation of the rotor.

Relative centrifugal force (RCF) is a measure of the magnitude of the centrifugal force to which a sample is subjected during a centrifugation run. RCF is dependent upon the radial distance of the sample from the axis of rotation of the centrifuge rotor. In instances when an adapter is utilized the sample container is usually not located within the recess at the greatest radial distance from the axis of rotation. For example, if it is desired to separate in a fixed angle rotor the contents of a liquid sample carried in a microtube using a centrifuge rotor having recesses which are sized to accomodate a standard test tube an adapter must be used. Currently available adapters able to accommodate a microtube are physically configured to substantially duplicate the exterior dimensions of the standard test tube. An opening is provided in the adapter that conforms in shape and length to the microtube. This opening is typically formed in the adapter adjacent the upper end thereof. Thus, when the microtube is received within the adapter and the adapter inserted into the sample receiving recess the sample is disposed at a distance from the axis of the rotation of the rotor that is less than the radial distance between the axis of rotation and the bottom of the sample receiving recess in the fixed angle rotor. As a result the sample is exposed to a lesser relative centrifugal force during a run of a given duration. Typical examples of such adapters of this type are those manufactured and sold by the Medical Products Department of E. I. du Pont de Nemours and Company, Inc. as model numbers P/N 00410, 00425, 00419 and 00381.

At the termination of a centrifugation run the sample container must be removed from the sample carrying recess. Care must be exercised in order to avoid remixing the separated constituents or components of the sample. The degree of care which must be exercised when removing the sample is increased when an adapter has been used to carry the sample container.

In view of the foregoing it is believed advantageous to provide an adapter which will permit a sample container to be disposed at the maximum radial distance within a recess in a given centrifuge rotor and at the same time be extractable from the recess without remixing the separated components in the sample.

SUMMARY OF THE INVENTION

In accordance with the present invention a tube adapter is provided which comprises a body member that has a tube receiving opening extending a predetermined distance into the body from a first end thereof. The opening in the adapter is configured to accommodate the tube. In a first embodiment the body has first and second groove segments each of which extend at least a predetermined substantially circumferential distance about the exterior of the body. Preferably the groove segments lie on the exterior of the body a predetermined distance from the first end thereof. The body is also provided with a first and a second access slot that open at diametrically opposed locations on the first end of the body and that respectively communicate with the first and second groove segments. Each of the slots extends substantially axially along the exterior of the body to its associated groove segment. Each slot has a predetermined width dimension associated therein. Each groove segment is defined by a first wall and a second wall, with the first wall being proximal to the first end of the body. The first wall of each groove segment adjacent its associated slot defines a respective first and second latching surface on the body.

In an alternate embodiment an uninterrupted groove extends circumferentially about the body. The groove is defined by a first and a second wall, with the first wall being closer to the first end of the body. Portions of the first wall adjacent to the slots define the first and second latching surfaces on the body members.

Further in accordance with the present invention an adapter removal tool is provided to facilitate the removal of an adapter as above described from the sample receiving recess of the rotor. The tool includes a main trunk portion having a first and a second leg extending in an axial direction therefrom. The legs are angularly arranged with respect to the trunk of the tool so as to define the same predetermined angular distance that the slots define with respect to the body of the adapter. That is, the legs are arranged on the trunk of the removal tool to circumferentially register with the slots on the body of the adapter when the adapter and the removal tool are coaxially aligned. Each of the legs has a grasping claw having a latching region thereon provided at its distal end. The claw extends either circumferentially or tangentially from the leg a distance less than the width dimension of the slot. The tool further includes a retainer in the form of a central piston which is biased in an axial direction away from the main trunk portion. The head of the piston is sized to engage against the flange of a tube received within the adapter.

The combination of the adapter and the removal tool permits a sample to be disposed within the recess of a fixed angle rotor at the maximum available radial distance while at the same time the tool facilitates the removal of the adapter with minimal risk of disruption to or remixing of the separated components of the sample. To operate, the legs of the tool are inserted through the slots so that the claws are brought into proximity to the latching surfaces on the body. Thereafter a slight angular rotation of the tool brings the claws into proximity with the latching surfaces so that an axially directed extracting force causes the claws to abut against the latching surfaces thereby to withdraw the adapter from the recess.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 3:
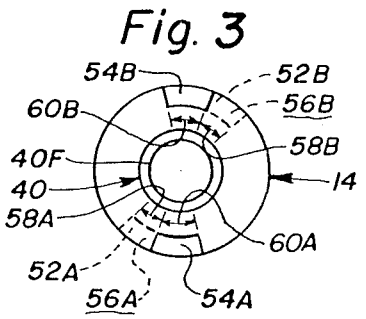
FIG. 3 is a plan view of the adapter shown in FIG. 2.

Throughout the following detailed description similar reference numerals refer to similar elements in all figures of the drawings.

Figure 1:
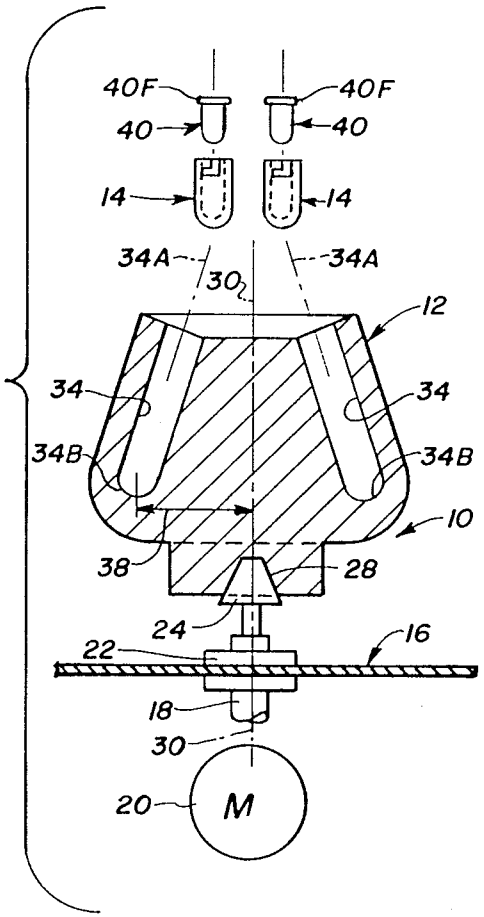
FIG. 1 is a highly styllized pictorial representation of a centrifuge apparatus with which an adapter in accordance with the present invention may be utilized.

With reference now to FIG. 1 shown is a highly styllized pictorial representation of a centrifuge apparatus 10 having a rotor 12 therein with which an adapter generally indicated by reference character 14 in accordance with the present invention may be utilized. The centrifuge 10 includes a chamber 16 of which only the floor portion is indicated in FIG. 1. A drive spindle 18 extends from a motive source 20 through a suitable sealing and bearing arrangement 22 into the interior of the chamber 16. The upper end of the drive spindle 18 is provided with a mounting element or spud 24.

The centrifuge rotor 12 has a mounting opening 28 formed in the undersurface thereof. The rotor 12 is physically mounted on the spud 24 whereby the rotor 12 may be driven rotatably about a central vertical axis of rotation 30. The rotor 12 includes a plurality of sample receiving cavities or recesses 34. The axis 34A of the recesses 34 is inclined at a predetermined angle with respect to the vertical axis of rotation 30. When the recesses 34 are so inclined the rotor 12 is known as a fixed angle rotor. When the recesses 34 are parallel to the axis 30 it is known as a vertical rotor. The fixed angle rotor is illustrated in FIG. 1 although it should be understood that the adapter 14 and removal tool hereafter to be discussed may be used with equal facility in conjunction with a vertical tube rotor. However, in this instance, the benefit of obtaining the maximum relative centrifugal force (RCF) using the adapter 14 is not able to be achieved, since the recess lies at the same radial distance from the axis 30 throughout its height. With a vertical rotor a spacer should be placed with the tube and adapter to present deformation of the tube and/or the adapter.

In the fixed angle rotor situation the closed bottom 34B of the sample receiving recess 34 lies at the greatest radial distance 38 from the axis of rotation 30. Therefore, in order to impose the maximum centrifugal force for a given rotational speed for a given time on a sample that sample should be disposed within the recess 34 at as great a radial distance as possible from the axis of rotation 30.

When it is desired to spin a sample contained in a container 40, such as a microtube, which has a physical dimension and configuration substantially dissimilar to that of the sample receiving recess 34 in which the container is to be received it is necessary to utilize the adapter 14 in order to position the container 40 within the recess 34. The container 40 typically includes a flange 40F. The adapter 14 in accordance with the present invention permits the container 40 to be positioned within the recess 34 in the rotor 10 so as to lie at as great a possible radial distance from the axis of rotation 30.

Figure 2:
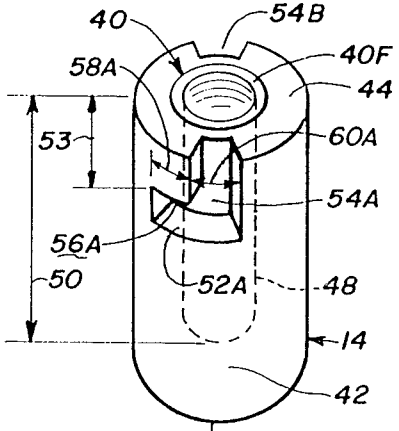
FIG. 2 is a perspective view of an adapter in accordance with the one embodiment of the present invention in which discrete groove segments are shown.

FIGS. 2 and 3 are, respectively, perspective and plan views of an adapter 14 in accordance with one embodiment of the present invention. The adapter 14 includes a body member generally indicated by reference number character 42 having a first or upper end 44 and a rounded lower end 46 thereon. The exterior configuration of the body of the adapter is adapted to closely conform to that of the recess 34 of the rotor 12.

The adapter 14 may be fabricated from any suitable material such as metal or plastic. The adapter body has a central tube receiving opening 48 that extends a predetermined distance 50 into the body 42 of the adapter 14 from the first end 44 thereof. The contour and the length 50 of the opening 48 is configured to match the exterior configuration and length of the particular container 40 whose dimension is to be adapted.

In one embodiment of the invention shown in FIGS. 2 and 3 the exterior surface of the body 42 of the adapter 14 is provided with first and second substantially circumferentially extended groove segments 52A and 52B respectively. The segments 52A and 52B respectively communicate with substantially axially extending slots 54A and 54B. The slots 54A, 54B open on the first end 44 of the body 42 and extend along the exterior of the body 42 to their associated groove segments 52A, 52B. The segments 52A, 52B each lie a predetermined distance 53 from the first end 44 of the body 42. The upper wall of the groove segment 52A, 52B closer to the first end 44 of the adapter 14 defines a latching surface 56A, 56B for a purpose to be made clearer herein. The latching surfaces 56A, 56B each extend at least a predetermined latching distance 58A, 58B from the respective slot 54A, 54B with which the groove segment 52A, 52B is associated. Each slot 54A, 54B has a predetermined width dimension 60A, 60B associated therewith. In the preferred embodiment segments 52A, 52B extend on diametrically opposed portions of the body of the adapter 14. The slots 54A, 54B are also angularly spaced one hundred eighty degrees on the body 42 of the adapter 14 such that the opening of the slots 54A, 54B are diametrically disposed on the upper end 44 of the body 42. It should be understand that any predetermined orientation for the slots and the segments may be defined on the exterior of the body of the adapter so long as the slots open on the first end of the adapter, the slots communicate with the respective groove segments, and a latching surface defining a predetermined latching distance is defined by the wall of the groove segment closer to the first end of the body of the adapter.

Figure 5:
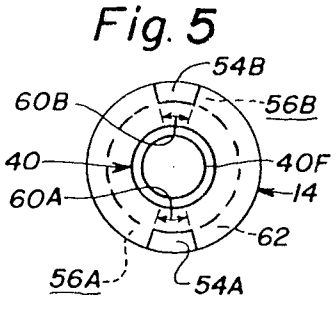
FIGS. 4 and 5 are perspective and plan views respectively similar to those shown in FIGS. 2 and 3 illustrating an alternate embodiment of the present invention in which a continuous groove is utilized.
Figure 4:
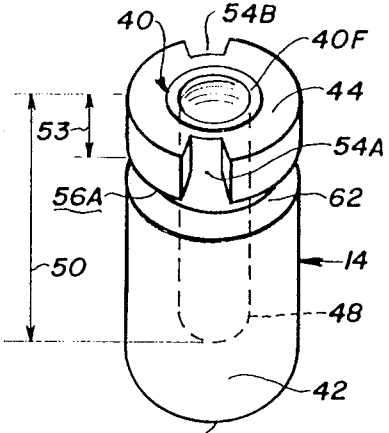

FIGS. 4 and 5 illustrate an alternate embodiment of the present invention in which the discrete groove segments 52A, 52B are replaced by a continuous, uninterrupted groove 62 that extends circumferentially about the exterior of the adapter 14. The region of the upper wall of the groove 62 adjacent the slots 54A, 54B defines the latching surface 56A, 56B. The slots 54A, 54B are themselves similar to those disclosed in the embodiment of the invention shown in FIGS. 2 and 3.

In operation, the sample container 40 is introduced into the opening 48 provided in the adapter 14. The adapter 14 is then introduced using a tool 70 to be described into the recess 34 of the rotor 10 and centrifuged in accordance with any desired operational protocol.

Figure 6:
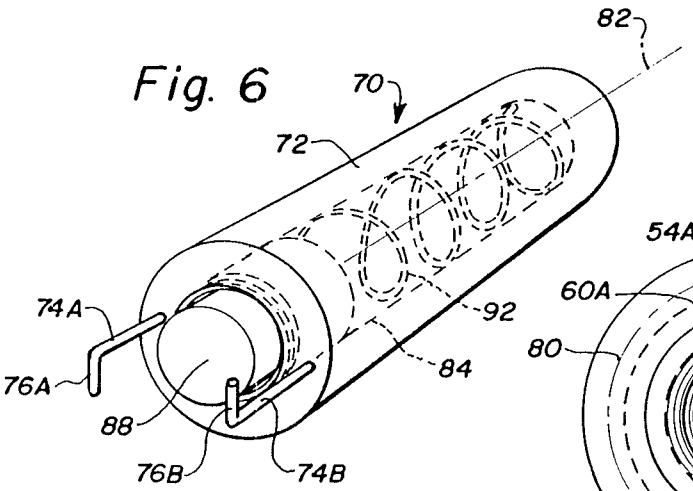
FIG. 6 is a perspective view of an adapter removal tool in accordance with the present invention.

With reference now to FIG. 6 shown is a perspective view of a removal tool 70 for inserting and removing the adapter 14 shown in FIGS. 2 through 5 from a sample recess 34 of the centrifuge rotor 12. The tool 70 includes a main trunk portion 72 having legs 74A and 74B extending axially therefrom. The lower ends of the legs 74A, 74B are bent so as to define a removal claw 76A and 76B respectively. Each claw 76A, 76B extends a predetermined distance 78A and 78B (FIG. 8) from the leg 74A, 74B with which it is associated. The distance 78A, 78B plus the thickness (diameter) of the respective associated leg 74A, 74B is less than the width dimension 60A, 60B of the slot 54A, 54B (FIGS. 2, 4). The legs 74A, 74B are angularly spaced with respect to the trunk 72 the same angular distance that the slots 54A, 54B occupy with respect to the body of the adapter 14.

Figure 8:
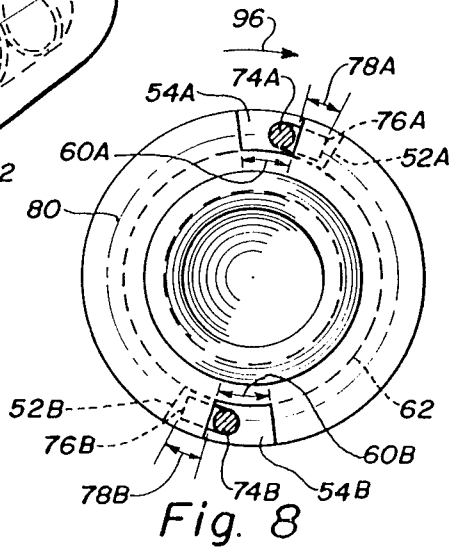
FIG. 8 is a sectional view taken along section lines 8—8 in FIG. 7.

As seen in FIG. 8 the claws 76A, 76B lie generally circumferentially on a circle 80 the center of which lies on the axis 82 of the tool 70. The claws 76A, 76B may extend tangentially with respect to such a circle 80.

Figure 7:
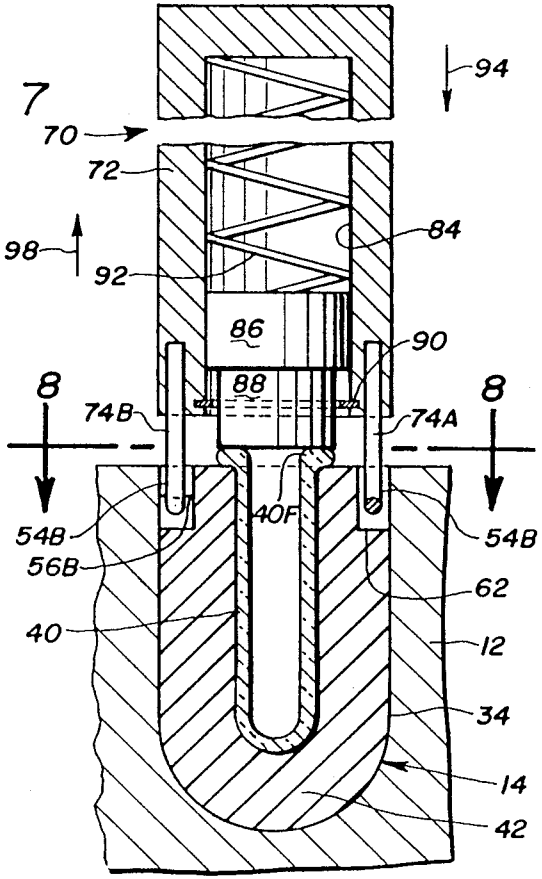
FIG. 7 is a vertical sectional view illustrating the interengagement of an adapter such as that shown in FIGS. 2 through 5 and the removal tool shown in FIG. 6.

As is best seen in FIG. 7 the interior of the trunk 72 of the tool 70 is hollow to define a cylinder 84 therein. A piston 86 having a protruding retainer head 88 is slidably received within the cylinder 84. The piston 86 is captured in the cylinder 84 by a ring 90. A biasing element 92 such as a spring imposes an axially directed biasing force on the piston 86 acting in the direction of the arrow 94.

In operation, as may be understood from FIGS. 7 and 8, at the termination of the run the legs 74A, 74B of the removal tool 70 are aligned with and introduced into a recess 34 of the rotor 12 and through the slots 54A, 54B so that the claws 76A, 76B are proximal to the latching surfaces 56A, 56B defined on the groove segments 52A, 52B or the groove 62. The adapter 14 in FIGS. 7 and 8 has the segments 52A, 52B superimposed on the uninterrupted groove 62 only for purposes of economy of illustration. The tool 70 is rotated in the direction of the arrow 96 (FIG. 8) so as to bring a latching claw 76 into engagement with the latching surface 56A, 56B on the groove segment 52A, 52B or the groove 62, as the case may be. Thereafter an extraction force in the direction 98 (FIG. 7) is applied to the tool 70 causing the claws 76 to abut the latching surfaces 56 permitting the tool 70 to withdraw the adapter 14 and the container 40 carried therein from the recess 34 of the rotor 12. The retainer head 88 of the piston 86 engages against the flange 40F of the container 40 that protrudes from the opening 48 in the adapter 14 thereby holding and securing the container 40 within the adapter 14 during the removal process.

Those skilled in the art having the benefit of the teachings of the present invention may impart numerous modifications thereto. It is to be understood, however, that these modifications lie within the scope of the present invention as defined in the appended claims.

WHAT IS CLAIMED IS:

1. A tube adapter comprising:

a body member having a first and a second end thereon, the body member having a tube receiving opening extending a predetermined distance into the body member from the first end thereof;

a first and a second groove segment each extending at least a predetermined distance about the exterior of the body, each groove segment being disposed a predetermined distance from the first end of the body; and a first and a second access slot respectively communicating with the first and the second groove segments, each slot opening on the first end of the body and extending along the exterior of the body to its associated groove segment.

2. The tube adapter of claim 1 wherein each groove segment has a first wall and a second wall, the first wall being closer to the first end of the body member than the second wall, the first wall of each of the groove segments adjacent its associated slot extending in a substantially circumferential direction about the exterior of the body member for at least a predetermined latching distance to define respective first and second latching surfaces on the body member.

3. The tube adapter of claim 2 wherein the slots each extend in a substantially axial direction along the exterior of the body member.

4. The tube adapter of claim 1 wherein the slots each extend in a substantially axial direction along the interior of the body member.

5. The tube adapter of claim 4 wherein the opening of each of the slots is diametrically disposed on the first end of the body member.

6. The tube adapter of claim 3 wherein the opening of each of the slots is diametrically disposed on the first end of the body member.

7. A tube adapter comprising:

a body member having a first and a second end thereon, the body member having a tube receiving opening extending a predetermined distance into the body member from the first end thereof;

an uninterrupted groove extending circumferentially about the exterior of the body, each groove segment being disposed a predetermined distance from the first end of the body; and a first and a second access slot respectively communicating with the groove, each slot opening on the first end of the body and extending along the exterior of the body to the groove, the groove having a first wall and a second wall, the first wall being disposed closer to the first end of the body member than the second wall, a portion of the first wall of the groove adjacent each of the slots defining a predetermined latching surface.

8. The tube adapter of claim 7 wherein the opening of each slot is diametrically disposed on the first end of the body member.

9. The tube adapter of claim 8 wherein the slots each extend in a substantially axial direction along the exterior of the body member.

10. The tube adapter of claim 7 wherein the slots each extend in a substantially axial direction along the exterior of the body member.

11. The tube adapter of claim 10 wherein the opening of each of the slots is diametrically disposed on the first end of the body member.

12. The tube adapter of claim 9 wherein the opening of each of the slots is diametrically disposed on the first end of the body member.

13. A tool for removing an adapter for a centrifuge tube from a recess in a centrifuge rotor, the adapter being of the type having a body member with a first end and a second end, the body member having a first and a second latching surface thereon, the body also having a first and second slot each opening on the first end of the body member and each extending along the body of the adapter, the slots being in communicating relationship with a respective one of the latching surfaces, the slots each having a predetermined width dimension associated therewith, the openings of the slots being spaced a predetermined angular distance apart on the first end of the body, the tool comprising:

a trunk portion;

a first and a second leg extending from the trunk portion, the legs being angularly spaced on the trunk at the same predetermined angular distance that the openings of the slots are spaced on the first end of the body of the adapter such that the legs are in a circumferentially alignable relationship with the slots on the adapter; and a claw extending from the lowermost end of each respective leg for a distance less than the latching distance, each leg and its associated claw having a predetermined width dimension, the width dimension of the end of each leg and its associated claw being less than the width dimension of the slot with which it is alignable.

14. The removal tool of claim 13 wherein the tube receivable in the adapter has a flange thereon that overlies the adapter, wherein the removal tool further comprises;

a retainer mounted in the trunk of the tool, the retainer having an exposed end thereon, the exposed end of the retainer being operably engageable with the flange on the tube carried in the adapter.

15. The retainer of claim 14 wherein the tool has a cylinder formed therein, a piston movably disposed in the cylinder, and a biasing element for biasing the piston within the cylinder, the retainer being disposed on the end of the piston.

16. A tube adapter comprising:

a body member having a first end thereon and a tube receiving opening extending thereinto from the first end thereof, the body having an exterior surface, a first and a second latching surface disposed on the exterior surface of the body, and a first and a second access slot respectively communicating with the first and second latching surfaces, each slot opening on the first end of the body and extending along its exterior surface to its associated latching surface.

17. The adapter of claim 16 further comprising:

a first and a second groove segment on the exterior surface of the body, each groove segment having a wall disposed closer to the first end of the body, the wall of each segment defining one of the latching surfaces on the body.

18. The adapter of claim 16 further comprising:

a continuous groove on the exterior surface of the body, the groove having a wall disposed closer to the first end of the body, portions of the wall defining the latching surfaces on the body.

* * * * *